US008465343B2

(12) United States Patent
Voet

(10) Patent No.: US 8,465,343 B2
(45) Date of Patent: Jun. 18, 2013

(54) FLOOR LEVELLING VEHICLE

(75) Inventor: Hans Voet, Hulshout (BE)

(73) Assignee: Alphaplan International, Hulshout (BE)

( * ) Notice: Subject to any disclaimer, the term of this patent is extended or adjusted under 35 U.S.C. 154(b) by 442 days.

(21) Appl. No.: 12/812,677

(22) PCT Filed: Jan. 19, 2009

(86) PCT No.: PCT/EP2009/050569

§ 371 (c)(1),
(2), (4) Date: Oct. 8, 2010

(87) PCT Pub. No.: WO2009/090266

PCT Pub. Date: Jul. 23, 2009

(65) Prior Publication Data

US 2011/0034109 A1 Feb. 10, 2011

(30) Foreign Application Priority Data

Jan. 17, 2008 (EP) ..... 08150380

(51) Int. Cl.
*B24B 1/00* (2006.01)

(52) U.S. Cl.
USPC ..... 451/28; 451/11; 451/350; 451/353

(58) Field of Classification Search
USPC ..... 451/353, 359, 11, 439; 125/25, 38
See application file for complete search history.

(56) References Cited

U.S. PATENT DOCUMENTS

| | | | | | |
|---|---|---|---|---|---|
| 682,999 | A * | 9/1901 | Reid | 451/353 |
| 3,129,539 | A * | 4/1964 | Tempero | 451/353 |
| 3,496,681 | A * | 2/1970 | Oswald | 451/353 |
| 3,888,052 | A * | 6/1975 | Panetti | 451/28 |
| 3,903,658 | A * | 9/1975 | Daiuta | 451/359 |
| 4,074,468 | A * | 2/1978 | Panetti | 451/347 |
| 4,891,858 | A * | 1/1990 | Wachter | 15/82 |
| 5,479,672 | A * | 1/1996 | Brown et al. | 15/98 |
| 5,605,493 | A * | 2/1997 | Donatelli et al. | 451/41 |
| 5,643,047 | A | 7/1997 | Beckett et al. | |
| 6,053,660 | A * | 4/2000 | Allen et al. | 404/112 |
| 7,261,623 | B1 * | 8/2007 | Palushi | 451/350 |
| 2003/0127904 | A1 | 7/2003 | Due | |
| 2005/0003715 | A1 * | 1/2005 | Hewitt | 440/12.5 |
| 2006/0025059 | A1 * | 2/2006 | Gueorguiev et al. | 451/350 |

FOREIGN PATENT DOCUMENTS

| | | | |
|---|---|---|---|
| DE | 44 08 749 | A1 | 9/1995 |
| GB | 2 147 529 | A | 5/1985 |
| WO | 2004/030862 | A1 | 4/2004 |
| WO | 2005/077599 | A1 | 8/2005 |

* cited by examiner

*Primary Examiner* — George Nguyen
(74) *Attorney, Agent, or Firm* — Sughrue Mion, PLLC

(57) ABSTRACT

This invention relates to a mobile floor levelling vehicle for levelling an undulating floor surface, which comprises a vehicle body with front and back displacement means for moving the vehicle body. To carry out the levelling operation the floor levelling vehicle comprises at least one grinding tool which is provided and driven to remove an amount of material from the floor, and at least one additional polishing device provided at a position behind the back displacement members in moving direction of the levelling vehicle.

18 Claims, 7 Drawing Sheets

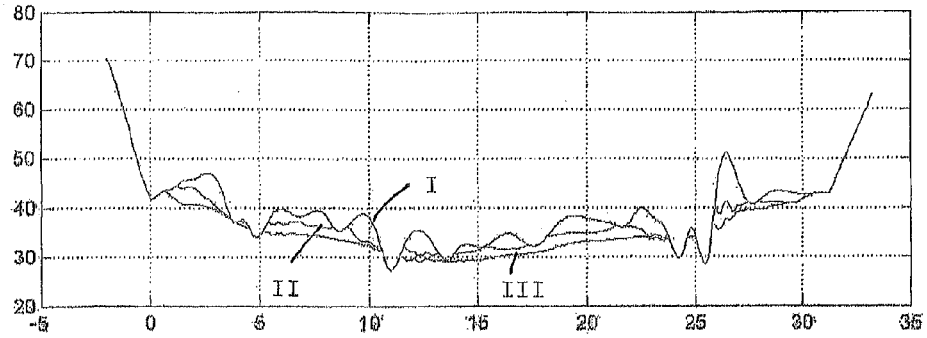
Fig. 4a1
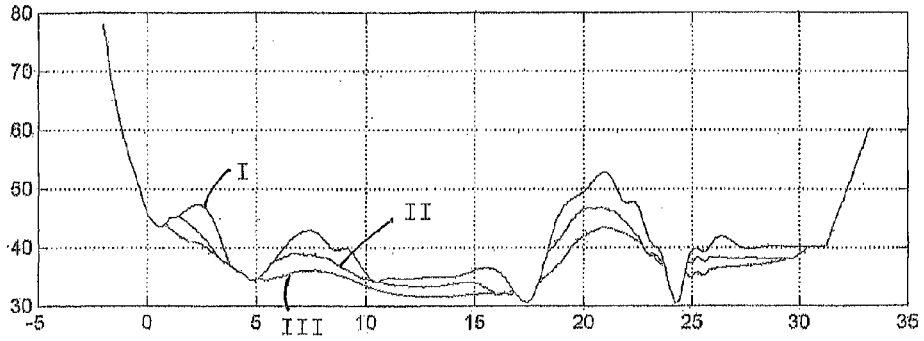
Fig. 4a2
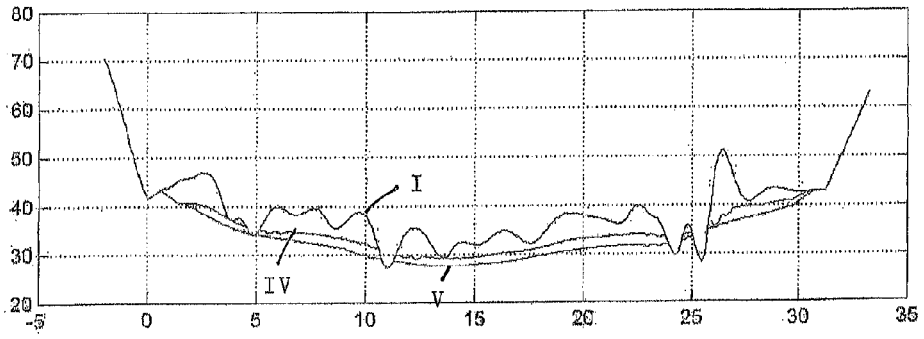
Fig. 4b1
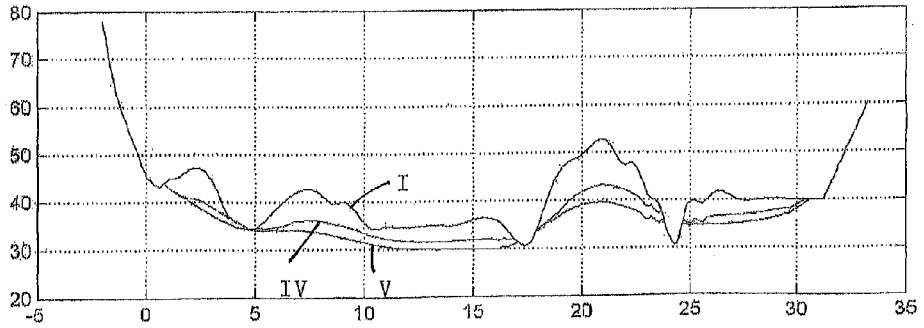
Fig.4b2

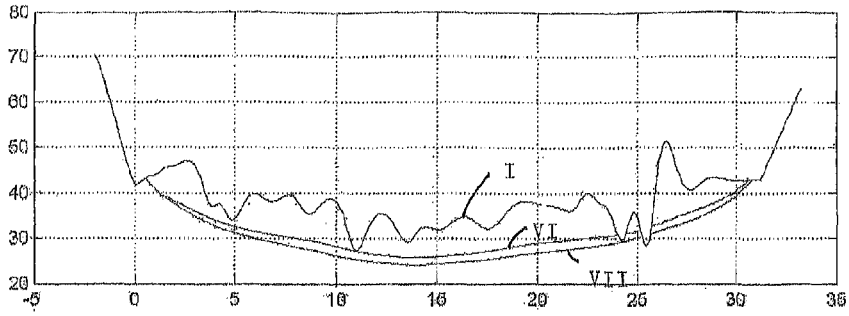
Fig. 4c1
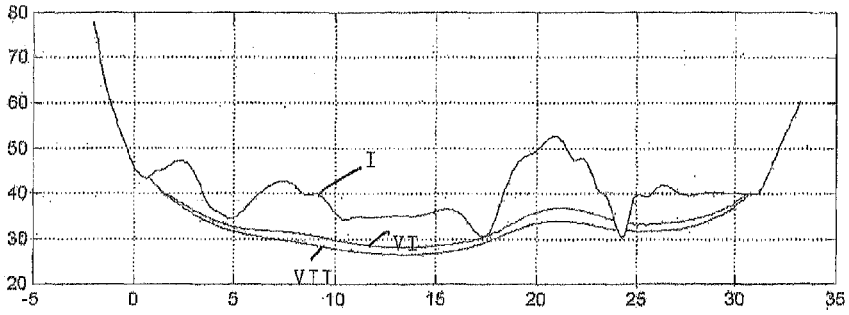
Fig. 4c 2
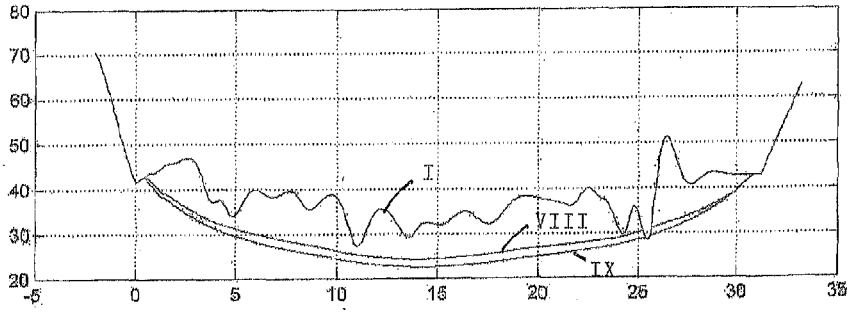
Fig. 4d1
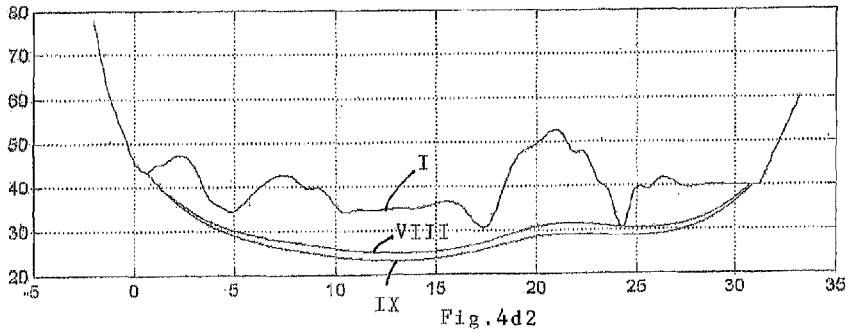
Fig.4d2

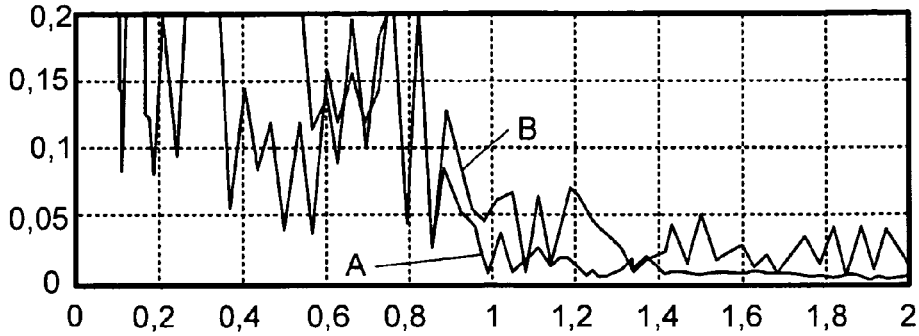
Fig. 5a1
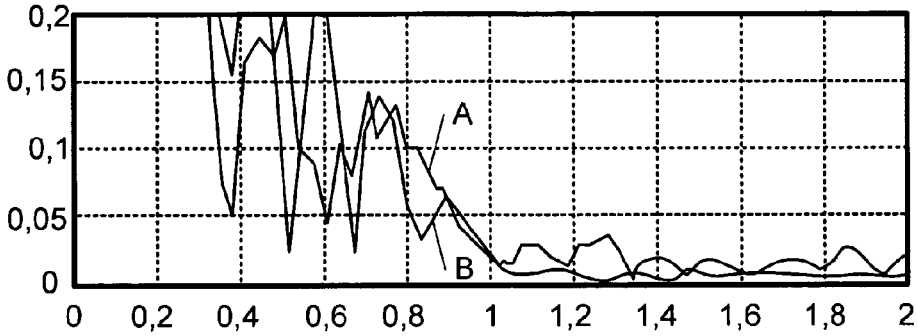
Fig. 5a2
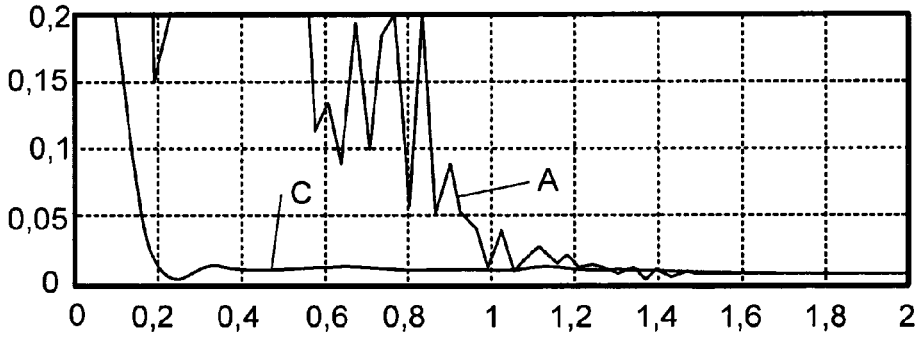
Fig. 5b1
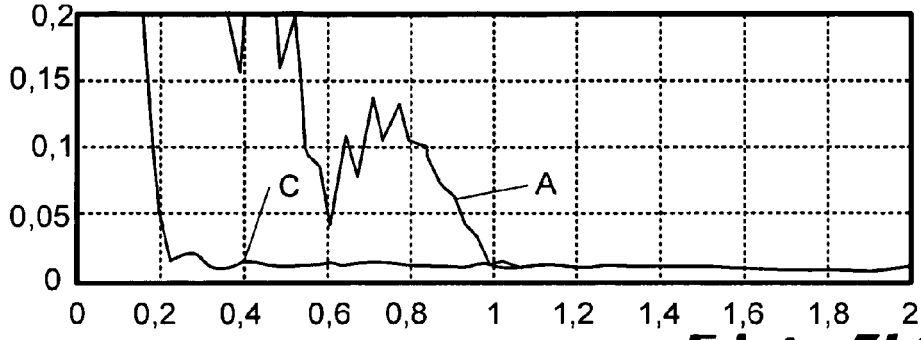
Fig. 5b2

FLOOR LEVELLING VEHICLE

CROSS REFERENCE TO RELATED APPLICATIONS

This application is a National Stage of International Application No. PCT/EP2009/050569 filed Jan. 19, 2009 claiming priority based on European Patent Application No. 08150380.7 filed Jan. 17, 2008, the contents of all of which are incorporated herein by reference in their entirety.

The present invention relates to a mobile floor levelling vehicle for levelling an undulating floor surface, which floor levelling vehicle comprises a vehicle body with a front and a back and a first and second longitudinal side, displacement means for moving the vehicle, comprising front displacement means mounted to the front of the vehicle body and back displacement means mounted to the back of the vehicle body; a vehicle driving for driving the movement of the displacement means at least one grinding tool mounted to the vehicle body, wherein the at least one grinding tool comprises a polishing device which is rotatable in a direction parallel to the floor surface and which is provided to contact the floor surface that needs to be levelled and to remove an amount of material from the floor to achieve the desired degree of levelling, the movement of the polishing device being driving by a second driving, according to the preamble of the first claim.

Such a vehicle is known from EP-A-1549462, which discloses a mobile floor levelling vehicle for removing undulations from an undulating floor surface. The vehicle is designed to level a floor in such a way that the occurrence of remaining undulations is permitted to an extent where they do not hamper the displacement of a vehicle over the floor. Or in other words undulations with a wavelength significantly longer than the length of the vehicles to be displaced over the floor may remain. Front side displacement means are positioned centrally of the vehicle body and preferably take the form of a sliding skate. Backside displacement means also take the preferred form of a sliding skate and comprise a first and a second member positioned on opposite longitudinal sides of the vehicle and at a fixed distance from each other in cross direction of the vehicle. Shifted towards the back of the vehicle, bulk part removing means are provided which comprise a plurality of parallel circular sawing heads rotationally mounted to a transversally extending rotation axis. The sawing heads are rotated in a direction perpendicular to the floor, they work the undulations in height direction and remove a bulk part thereof, leaving a surface with a high roughness. Shifted towards the back of the floor levelling vehicle at least one polishing device is provided, for smoothening a surface area that has been worked by the bulk part removing means. The polishing device is rotated in a direction substantially parallel to the floor surface. To improve the levelling operation, the backside displacement means are positioned such that they move over the track that has been worked by the bulk part removing means and the polishing devices when forwarding the vehicle.

The vehicle disclosed in EP-A-1549462 is designed in such a way that the desired degree of levelling is usually obtained after one single operation. Thereto the bulk part removing means are positioned such that a rather thick layer is removed from the floor in one go, which is time consuming. Besides that this, the distance between the bulk part removing means and the polishing devices is not variable in cross direction of the vehicle. As a consequence, the distance between the polishing devices cannot be adjusted to the width of the path to be levelled. Therefore, before each operation, the vehicle needs to be fully adapted to the width of the corridors that need to be levelled. This is time consuming and renders the method expensive.

There is a need to a floor levelling vehicle which is more versatile and which is more easily adaptable to corridors of varying width.

This is achieved according to the present invention with a floor levelling vehicle showing the technical features of the characterising part of the first claim.

Thereto, the vehicle of this invention is characterised in that 1. the front displacement means comprise a first and second oblong front displacement member mounted respectively to the opposite first and second longitudinal sides of the vehicle body, which first and second front displacement member extend in longitudinal direction of the vehicle and are rigid in longitudinal direction
2. the back displacement means comprise a first and second oblong back displacement member mounted respectively to the first and second longitudinal side of the vehicle body in cross direction thereof, the first and second back displacement members extending in longitudinal direction of the vehicle
3. wherein the first front and back displacement member are mounted to a first rigid longitudinally extending axis of the vehicle body, and the second front and back displacement member are mounted to a second rigid longitudinally extending axis of the vehicle body,
4. wherein the first front and back displacement members on the one hand and the second front and back displacement members on the other hand are provided to move over a same track
5. wherein the back displacement members are provided to move over a track that has been levelled by the at least one grinding tool,
6. wherein the front and back displacement members are tiltable with respect to the vehicle body in longitudinal direction of the vehicle.

The inventor has analyzed the problems occurring with existing wheeled floor levelling vehicles, with floor levelling vehicles having front displacement means which are not elongated and/or not rigid in longitudinal direction, but which in stead comprise wheels or two or more hingedly mounted members such as is for example the case with boogie wheels. With such displacement means the amplitude of at least part of the undulations present on the floor surface may be averaged. This is particularly the case for those undulations occurring at a frequency which is substantially smaller or substantially larger than the distance between the wheels at the front and back of the vehicle, in case of a wheeled vehicle. This is however not the case for undulations occurring at a frequency which corresponds to the distance which approximates the distance between the wheels in longitudinal direction of the vehicle or to the distance between subsequent hinge points in the front or back displacement member in longitudinal direction: those undulations appear not be averaged but are in stead accentuated. The inventor has found that while with every additional pair of wheels or every additional hinge point in longitudinal direction of the vehicle the amplitude or height of those undulations will be reduced by the levelling operation, new undulations will be created. In practice the presence of a pair of wheels or a hinge point will create undulations, at a doubled frequency. As the distance between every additional pair of wheels or every additional hinge point in longitudinal direction of the vehicle often approximates the distance between the front and rear wheels of trucks or vehicles that are use the floor surface, the newly created undulations occur at a distance which is such as to cause swinging and bumping of the trucks. In practice not only the number of undulations occurring between the front and back wheels appears to increase, but the amplitude of the undulations remains such that it hampers the displacement of trucks over the levelled floor.

When analyzing the problems occurring with existing floor levelling vehicles, it became clear to the inventor that the solution to obtaining a sufficient levelling of the floor should not be sought in increasing the number of hinge points or wheels as an attempt to average the amplitude of occurring undulations to a better extent and to reduce the frequency of the undulations to the best attainable minimum. It became clear that the solution should in stead be sought in providing the floor levelling vehicle with displacement members which are not capable of distinguishing individual undulations occurring at a short distance from each other, i.e. undulations occurring a distance which approximates the distance between the front and back wheels of the vehicles that are to move over the floor.

By using front and back displacement members which are both elongated and rigid in longitudinal direction, individual undulations with a wavelength which is shorter than the length of the displacement member will not be sensed by the displacement member. In stead thereof, a combination of the global floor profile of the contact surface area between the lower floor contacting surface of the elongated rigid displacement member and the floor surface, and the weight distribution over the displacement member will determine the position of the displacement member. Or in other words, the presence of front and back displacement members which are elongated and rigid in longitudinal direction of the levelling vehicle, results therein that the displacement of the vehicle over the floor is determined by the large scale profile of the floor over which the vehicle is moving and not by the individual undulations present on the floor. As a consequence the frequency of the up- and downward movement of the vehicle body caused by the undulations occurring at a wavelength shorter than the length of the displacement member will be reduced, and the movement of the grinding tool in height direction will proceed much more gradually and will be governed by the contact surface area between the lower floor contacting surface of the elongated rigid displacement members and the floor surface.

In the floor levelling vehicle of this invention the front displacement means will move over a surface or a track that has not been worked yet or over a surface or track that has been worked to a lesser extent as compared to the surface over which the back displacement means are moving. The back displacement means are provided to move over a track that has been worked by the grinding tool, thus reducing the up- and downward movement of the back displacement. The ensuing advantage is that the overall up- and downward movement of the vehicle and the grinding tool will be reduced as well, this resulting in an improved levelling of the undulations occurring at a distance which corresponds to the distance between the front and back displacement members of the levelling vehicle.

An instant and acceptable levelling of the floor profile may be achieved in one go, without the need to determine the original floor profile in advance. However, depending on the original floor profile and on the layer thickness that is removed from the floor, it may also happen that a first levelling operation may deteriorate the floor profile as is illustrated in FIG. 4. The inventors have now found that by a simple repetition of the levelling operation a few times, thus by moving the floor levelling vehicle several times over the floor surface, the degree of levelling may be improved with every repetition. Regardless of the repeated working, the desired degree of levelling will be achieved in a shorter period of time as compared to the state of the art, without the need to determine the original floor profile in advance. This continued improvement of the levelling is attributed to the fact that when repeating the levelling operation, the front displacement members are every time moving over an already levelled track and the back displacement members are moving over a track that has been levelled once more. As a result the amplitude of the up- and downward movement of the back displacement members will be reduced as compared to that of the front displacement member. This way the smoothness of the levelling operation is further improved.

This result may be achieved because the front and back displacement members are mounted to a rigid longitudinally extending axis, forming part of or being mounted to the vehicle body.

The floor levelling vehicle of this invention presents the advantage that although large scale undulations occurring at a distance which exceeds the distance between the front and back displacement member or their tilting points are removed to a lesser extent when compared to the prior art, the levelling operation will proceed at a higher speed as less material is removed per go. The person skilled in the art will be capable of adapting the length of the displacement member such that the undulations occurring at a distance which approximates the distance between the front and back wheels of a wheeled vehicle that is to move over the floor and would hamper the displacement of that wheeled vehicle, are removed. The rigidity of the elongated front and back displacement members guarantees that the displacement members remain in permanent contact with at least part of the tops of the undulations on the floor, regardless of the dimensions of the undulations especially in height direction. The result is that a smoother levelling of the floor surface is achieved.

The tiltable mounting of the at least one grinding tool to the floor levelling vehicle permits positioning the grinding tool in such a way that an optimum compromise is achieved between reducing the resistance sensed by the grinding tool when contacting the slope of an undulation in the course of a polishing operation and guaranteeing an optimum contact surface area with the floor surface so that the risk to the formation of protruding edges and rings is minimized to the best extent, at minimum material removal. As a result of the tilted mounting, the displacement of the floor levelling device proceeds in a smoother way. By varying the position of the grinding tool, the layer thickness that is removed from the floor may be controlled. By controlling the amount of material that is removed, the operation speed may be varied.

The grinding tool is preferably fixed in a certain tilted position, in particular canted towards the back so that the polishing surface faces upcoming undulations. The angle between the grinding tool and the floor surface will usually be adaptable. This is done to minimize the risk to the formation of ring shaped profiles on the floor. The person skilled in the art will be capable of adapting the position of the grinding tool to the nature of the floor to be levelled.

The vehicle driving and the driving of the grinding tool preferably are separate from and mounted externally to the floor levelling vehicle and connected thereto.

Within the scope of this invention, levelling of the floor does not mean that the floor will be perfectly horizontal after the levelling operation has been finished. Levelling rather means that the floor is worked in such a way that undulations, which may be undulations which protrude with respect to the floor as well as recessed holes, are completely removed or removed in such a way that their amplitude is reduced and to an extent that they occur at a wavelength which does not hamper the movement of vehicles. This brings flatness but not horizontally. This means in practice that undulations with a long wavelength of several meters or several tens of meters may remain. Or in other words undulations with a wavelength substantially larger than the distance between the wheels of the vehicles moving over the floor, in longitudinal direction of the vehicle, may remain. Within the scope of this invention substantially larger means at least twice the distance between the wheels. Undulations with very small wavelengths of a few cm will usually be removed during the first working of the floor.

The present invention also relates to a method for polishing an undulating floor wherein the above described mobile floor leveling vehicle is moved over a corridor floor that needs to be levelled, wherein a first and second track on opposite sides of the corridor are leveled by respectively the first and second grinding tool, followed by moving the first and second back displacement member over the first and second track, wherein the leveling operation is repeated by moving the first and second displacement member over the first and second track and the first and second track are worked again by the first and second grinding tool.

Preferably a third track, positioned between the worked first and second track, is worked by an additional grinding tool connectible to the floor leveling vehicle, whereby the additional grinding tool is moved by displacement members which are provided to move over the worked first and second tracks. Thereto, the additional grinding tool may be moved either by the floor leveling vehicle of this invention or by any other vehicle, the displacement members of which are provided to move over at least one of the worked first and second tracks.

According to a further preferred embodiment, a fourth and a fifth track positioned between or beyond the first and second track are worked by an additional grinding tool, in particular a second an third additional grinding tool, which is connectible to the floor leveling vehicle, whereby the additional grinding tool is moved by displacement members which are provided to move over the worked first and second tracks. Thereto, the additional grinding tool may be moved either by the above-described floor leveling vehicle of this invention or by any other vehicle, the displacement members of which are provided to move over at least one of the worked first and second tracks.

The invention is now disclosed in further detail in the appending figures and description of the figures.

FIG. 4 shows the levelling by the left and right grinding tool on a floor surface after having been subjected to several levelling operations:

FIG. 4*a*: level of original floor and levelling after 1 and 2 levelling operations FIG. 4*b*: level of original floor and levelling after three levelling operations FIG. 4*c*: level of original floor and levelling after four and five levelling operations FIG. 4*d*: level of original floor and levelling after six and seven levelling operations.

The Y-axis designates the absolute height (in mm) of the undulations occurring on the floor as a function of length of the path to be levelled (in m) designated by the X-axis.

FIG. 5 shows the analysis of the frequency with which undulations occur on the floor before levelling, after one levelling operation and after the levelling operation has been completed. The Y-axis shows the amplitude of the undulations in mm, the X-axis shows the frequency with which the undulations occur (in 1/m).

In practise, newly constructed floors or floors that have been used for some time comprise undulations which hamper the movement of vehicles and cause swinging and bumping of the vehicles. This is unwanted, in particular in case of warehouses where the floor is used by heavily loaded aisle trucks, with an elevated gravity point. The elevated gravity point in combination with the occurrence of bumps on the floor, involves a risk to bumping and toppling over of the trucks. The present invention relates to a floor levelling vehicle and to a floor levelling method for levelling such an undulating floor.

Figure 1:
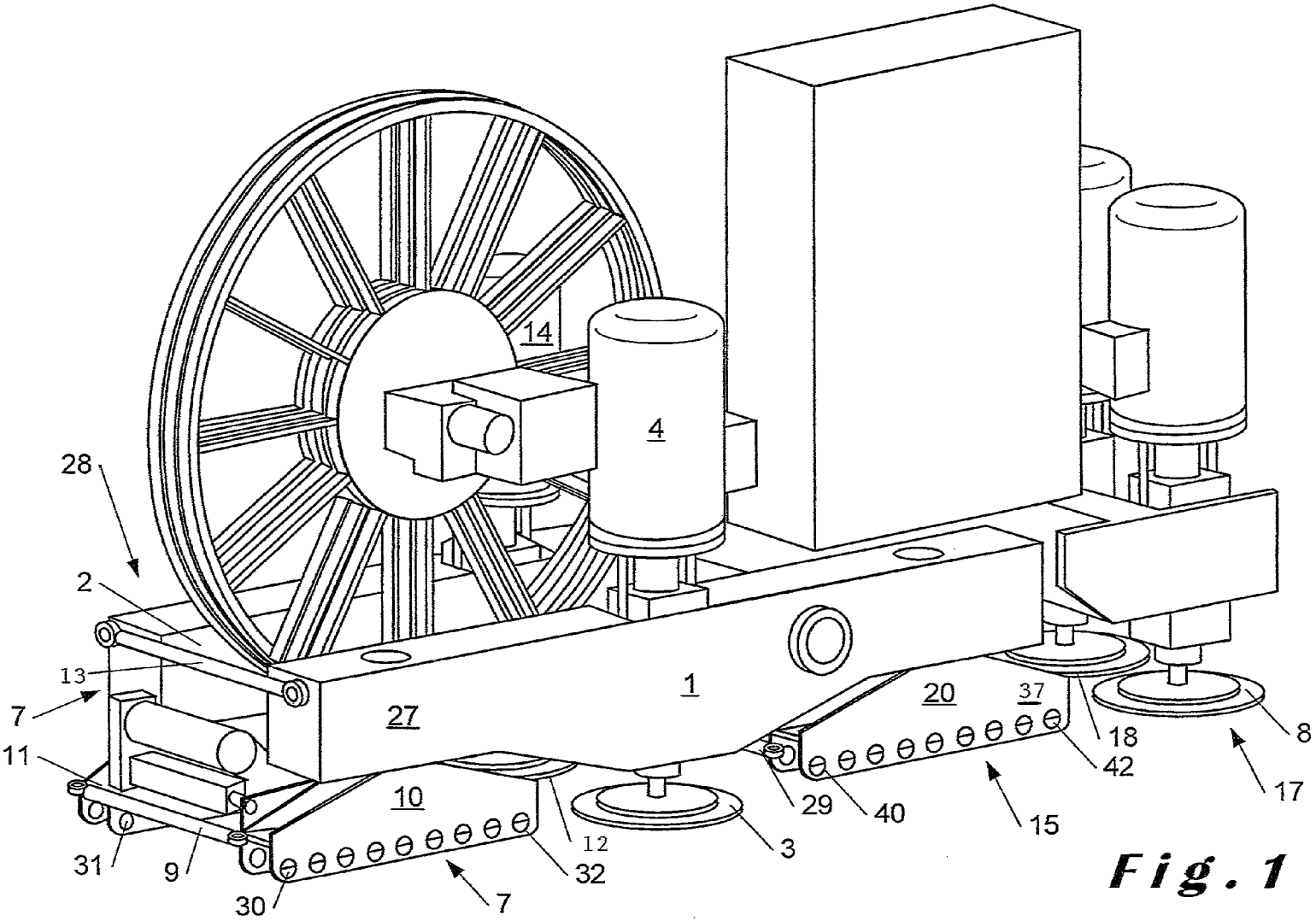
FIG. 1 shows a schematic view to the side of a mobile floor levelling vehicle of this invention.
Figure 2:
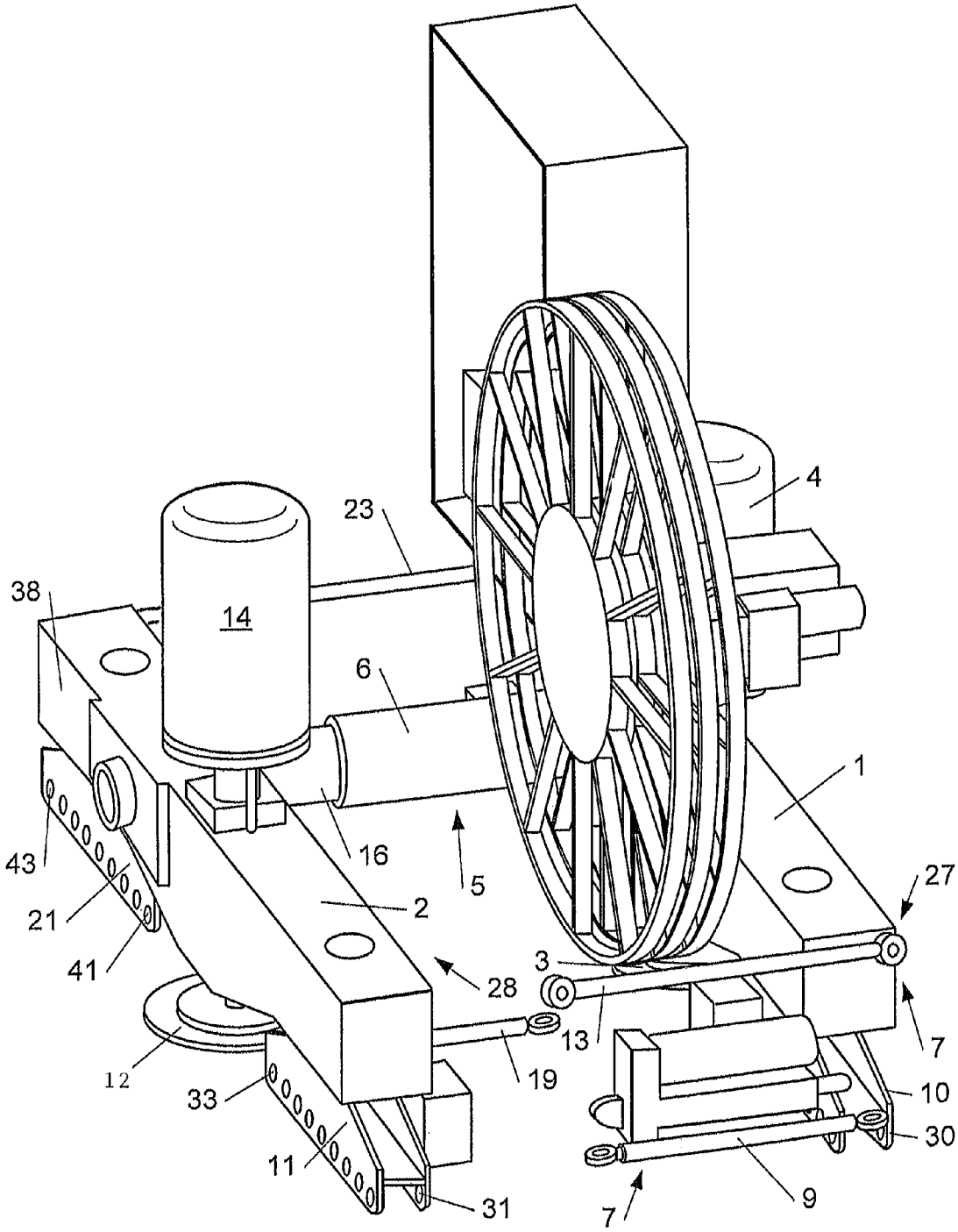
FIG. 2 is a schematic view to the mobile floor levelling vehicle of this invention.

As can be seen from FIGS. 1 and 2, a preferred embodiment of the mobile floor levelling vehicle of this invention comprises a vehicle body 15 which is rigid in longitudinal direction. Thereto the vehicle body 15 comprises a first and a second longitudinally extending rigid axis 1, 2, but other technical features known to the person skilled in the art for making the vehicle body 15 rigid in longitudinal direction may be envisaged as well. The first and second axis 1, 2 may form part of the vehicle body 15 or be connected thereto according to any method known to the person skilled in the art. The first and second axis 1, 2 preferably run substantially parallel, although they may extend under an angle with respect to each other as well. The axis 1, 2 may take the shape of a conventional axis or any other shape considered suitable by the person skilled in the art, for example a rigid plate. The axis 1, 2 are preferably made as separate parts but they may be made in one part as well.

The vehicle body 15 comprises front displacement means 10, 11 mounted to opposite sides of the front part 7 of the vehicle body in cross direction thereof and back displacement means 20, 21 mounted to opposite sides of the back part 17 in cross direction of the vehicle body 15. According to a preferred embodiment, the front displacement means comprise a first front displacement member 10 mounted to a front part 27 of the first longitudinal axis 1, and a second front displacement member 11 mounted to a front part 28 of the second longitudinal axis 2. According to a preferred embodiment the back displacement means 20, 21 comprise a first back displacement member 20 mounted to a back part 37 of the first longitudinal axis 1 and a second back displacement member 21 mounted to a back part 38 of the second longitudinal axis 2. However if so desired, the front and/or back displacement members may be mounted to any other part of the vehicle body considered suitable by the person skilled in the art.

The front displacement members 10, 11 have an elongated shape, they are oblong, they preferably extend in longitudinal direction of the vehicle body 15 and are rigid in their longitudinal direction. Likewise, the back displacement members 20, 21 preferably have an elongated shape in longitudinal direction of the vehicle body 15, they are oblong and are rigid in their longitudinal direction. Each of the front and back displacement members 10, 11, 20, 21 is constructed as a rigid part, forming a rigid unity in longitudinal direction of the displacement member. This rigidity of the front and back displacement members is particularly important and is to be preferred over a displacement member comprising a plurality of sub-members hingedly mounted to the displacement member as is the case with for example boogie wheels. The reason is that in the latter case of hingedly mounted sub-members, the amplitude of the displacement of the vehicle in height direction when taking an undulation would be reduced to a ratio corresponding to 1/number of hinging connections, but the frequency with which this undulation is taken by the vehicle would be multiplied by the number of hinging connections. This multiplied taking of the undulations by the levelling vehicle will induce the creation of additional undulations on the floor, and in the end will create a floor showing undulations at short distance or frequency in longitudinal direction of the track. As a consequence, resonance will be induced to a vehicle moving over the levelled track, which is undesirable as it implies a vibrating motion.

Within the scope of this invention any rigid displacement member known to the person skilled in the art may be used. The displacement members may for example take the shape of a sliding skate, a caterpillar surrounding two or more wheels or any other rigid member known to the person skilled in the art. In case use is made of a skate, the skate may for example comprise a plurality of wheels extending through a series of openings in the bottom face of the skate to provide a smooth moving operation, or a sliding strip attached to the bottom face of the skate.

The front and back displacement members 10, 11, 20, 21 preferably have a length which is adapted to the distance between the front and back axle of the vehicle that will be using the floor after the levelling operation has been finished, to achieve a levelling which is adapted to the vehicles that will be using the floor afterwards. This way a levelling may be obtained which is such that undulations whether protruding or countersunk having a length that is shorter than the length of the displacement member, will not be sensed but will rather be filtered by the displacement member. In that way that the displacement member will be moving over the global profile provided by the undulations without sensing the individual protrusions and recesses of the undulations. Thereby the displacement member may be moving over the tops of the undulations but also over the slope, depending on the dimensions of the undulations and the displacement member relative to one another. As a result all undulations having a length shorter than the length of the displacement member will at least partly be removed by the levelling operation. The longer the length of the displacement members, the better the filtering obtained. In view of the dimensions of the vehicles that have to use the floor afterwards, in particular the distance between the front and back wheels, the length of the displacement member 10, 11, 20, 21 of the floor levelling vehicle should be sufficiently long, preferably at least 0.75 meter, more preferably at least 1 meter. However the length of the displacement members 10, 11, 20, 21 should not be too long to ensure that the levelling vehicle is still manoeuvrable in the space that needs to be levelled. The person skilled in the art will be capable of defining the optimum compromise between sufficient manoeuvrability and sufficient length.

The front displacement members 10, 11 may have the same or a different length as compared to the back displacement members 20, 21. The front displacement members 10, 11 may have a length which is substantially longer than the length of the back displacement members 20, 21. This may have the advantage that the up- and downward movement of the vehicle body and thus the grinding tools 11, 12 is reduced, thus improving the levelling that may be obtained: as the front displacement members will usually be moving over a non- of less worked track containing more intensive undulations than the worked part of the track, a better filtering will be obtained. According to another preferred embodiment, the front displacement members 10, 11 have the same length as the back displacement members 20, 21. In that case, a symmetric vehicle is provided, which may be used as a back and forth moving vehicle without the need to be turned around when reversing the displacement direction of the vehicle. In other words at the time either the front displacement means may function as front displacement means, or the back displacement means may function as front displacement means.

To ensure a permanent contact between the bottom, ground contacting surface of the front and back displacement members 10, 11, 20, 21 and the floor to be levelled, to improve the levelling provided and to increase the speed with which the levelling may be carried out, the front and back displacement members 10, 11, 20, 21 preferably are mounted tiltably or hingedly to respectively the first and second longitudinal axis 1, 2.

The displacement members 10, 11, 20, 21 preferably are mounted to the vehicle body or the longitudinal axes 1, 2 in such a way that they may rotate about an axis which runs substantially perpendicular to the longitudinal axis 1, 2. This way the position of the displacement members may be varied from a position wherein they extend parallel to the longitudinal axis 1, 2 to permit forwarding the levelling vehicle in longitudinal direction, or the displacement members may extend under an angle to permit steering the displacement of the levelling vehicle in any envisaged direction.

The first and second front displacement members 10, 11 respectively comprise a first and second front end 30, 31 and a first and second back end 32, 33. The first and second front end 30, 31 are connected to each other by means of a first front rigid member 9, and the first and second back end 32, 33 are connected to each other by means of a first back rigid member 19. Similarly, the first and second back displacement members 20, 21 respectively comprise a first and second front end 40, 41 and a first and second back end 42, 43. The first and second front end 40, 41 are connected to each other by means of a second front rigid member 29, and the first and second back end 42, 43 are connected to each other by means of a second back rigid member. The connection guarantees that the front displacement members 10, 11 are maintained in a parallel position, that the back displacement members 20, 21 are maintained in a parallel position regardless of the profile of the floor surface, and that the back displacement members are maintained in the track that has been levelled by the grinding tools. This is important as it significantly improves the result of the levelling operation. The inventor has also observed that this connection increases rigidity of the displacement members in cross direction of the vehicle and improves steering possibilities of the levelling vehicle in any envisaged direction, regardless of the profile of the floor over which the vehicle is moving. This is important as the first and second longitudinal side of the vehicle body, or in other words the left and right side of the vehicle body, may be moving over a floor surface part with a different profile, as a result of which the first side may be at a different height as compared to the second part. This embodiment permits to achieve an improved levelling of the floor surface regardless of the floor profile sensed by the first and second front and back displacement members.

According to another preferred embodiment, the front parts 27, 28 of the first and second longitudinal axis 1, 2 are connected to each other by means of a front connecting member 13 which extends in cross direction of the vehicle body. Similarly, preferably also the back parts 37, 38 of the first and second longitudinal axis 1, 2 are connected to each other by means of a back connecting member 23 which extends in cross direction of the vehicle body. This way the over-all rigidity of the vehicle body may be increased, which improves the over-all result of the floor levelling operation. To permit absorbing level differences occurring between the first and second side of the vehicle body, which would subject the connecting members 13, 23 to torsion forces, at least one of the ends of each connecting members 13, 23 is connected to the longitudinal axis by means of a pivoting joint which permits rotation or moving the connecting members 13, 23 in a plane perpendicular to the moving direction of the vehicle or perpendicular to the longitudinal axis 1, 2. Preferably however, both opposite ends of the front and back connecting member are connected to the longitudinal axis by means of a pivoting joint. This way movement of one longitudinal side of the vehicle body with respect to the other in height direction of the vehicle body is permitted and level differences occurring in the floor surface between the left and right side of the vehicle body may be accommodated. In stead of a pivoting joint, any other connecting means may be used which permit moving the connecting members 13, 23 in a plane perpendicular to the moving direction of the vehicle or perpendicular to the longitudinal axis 1, 2.

Preferably the distance between the first and second longitudinal axis 1, 2 is variable, to permit adapting it to the width of the corridor through which the levelling vehicle is moving or to the width of the path to be levelled. Thereto, the first and second longitudinal axis 1, 2 are connected to each other in cross direction of the vehicle body 15. The connection is preferably established at a substantially central position in longitudinal direction of the axes 1, 2, but it may be established at any other point as well although this is considered less advantageous in relation to the reversibility of the floor levelling vehicle. Preferably the connection is established by means of a cross axis 5, with a length which is variable in cross direction of the vehicle. This length variability may be achieved by using a cross axis 5 which comprises a first and a second axis part 6, 16, which are preferably co-axial, telescopic or slideable with respect to each other in cross direction of the vehicle. The length of the first and second co-axial axis parts 6, 16 is chosen such that their walls overlap at least partly at their second ends, to a larger or lesser extent and that their length is sufficient to account for the most frequently occurring path widths to be levelled. The first axis part 6, may for example take the shape of a tube which is connected with one end to the first longitudinal axis 1 of the vehicle body 15. The second axis part 16 may for example take the shape of a second tube or rod with a smaller diameter than the first tube 6. The second axis part 16 is connected with one end part to the second longitudinal axis 2 of the vehicle body 15. The first and a second co-axial axis part 6, 16 are preferably also rotatable with respect to each other along a longitudinal axis of the cross axis 5 to permit accommodating and compensating within the vehicle body 15 height differences occurring on the floor surface over which the vehicle is displaced.

The cross axis 5 may take any shape considered suitable by the person skilled in the art, taking into account its function. The cross axis 5 may for example comprise a substantially cylindrical first and second part 6, 16, however these parts may also have an oval cross section or be rod shaped. Preferably however the first and second part 6, 16 are cylindrical as this ensures optimum rotatability and displaceability in longitudinal direction of the cross axis 5.

In view of the need to be able to vary the distance between the first and second longitudinal axis 1, 2 preferably also the length of the front and back rigid members 9, 19, 29 connecting respectively the front and back parts of the front and back displacement members 10, 11, 20, 21 is variable; and preferably the length of the connecting member 13, 23 connecting the front and back part of the longitudinal axes 1, 2 is variable.

The mobile floor levelling vehicle of this invention also comprises at least one grinding tool 3, 12 mounted to the vehicle body, preferably however two grinding tools are provided one opposite longitudinal sides of the vehicle body 15. However if so desired, additional grinding tools may be added in cross direction of the floor levelling vehicle to permit levelling two or more parallel paths in one go. Additional grinding tools may be also be added in longitudinal direction of the floor levelling vehicle, at a position between the front and back displacement means to permit increasing the levelling speed. In longitudinal direction of the floor levelling vehicle, the at least one grinding tool 3, 12 is mounted at a position between the front and back displacement means. The at least one polishing may be positioned at a position shifted towards the front displacement members 10, 11 as this guarantees that undulations will be removed to a larger extent. Or in other words this guarantees that more material will be removed. Preferably however, the first and second grinding tool 3, 12 are disposed substantially central in longitudinal direction of the vehicle body, to provide a symmetrical vehicle, the moving direction of which may be reversed without the need to turn the vehicle around. Preferably the position of the grinding tool 3, 12 and of the additional grinding tools is adjustable in height direction of the levelling vehicle to permit adapting the amount of material that is removed in a levelling operation. Thereby it may be preferred to position the grinding tool in such a way that its floor contacting surface extends somewhat below the level of the displacement members to permit removing undulations to a level to somewhat below the contact surface between the back displacement means and the floor surface.

If so desired, one or more additional grinding tools 8, 18 may be mounted to the vehicle, at a position behind the back displacement members 20, 21. According to a preferred embodiment, the at least one additional grinding tool 8, 18 is mounted to an additional vehicle, which is connectible to the vehicle body 15.

According to a first preferred embodiment, the additional vehicle comprises one single grinding tool, mounted at a position which would level a track between the first and second grinding tool 3, 12. This permits levelling of a track which extends between the tracks that have been levelled by the first and second grinding tool. To achieve this, usually the levelling vehicle will be moved over the floor, the number of times required to achieve the desired degree of levelling by the first and second grinding tools 3, 12. This way, a first and a second track on opposite sides of the corridor are levelled. In the course of this operation, the additional grinding tool will usually not contact the floor. After the opposite first and second track have been levelled, the first and second grinding tool 3, 12 are lifted in such a way that they do no longer contact the floor, the additional grinding tool is lowered and an additional track, which extends between the first and second track, is levelled. Depending on the positioning of the additional grinding tool, this may be achieved in one go or in two or more levelling operations. The additional polishing tool may be mounted to the floor levelling vehicle when levelling the additional track, but it may also be mounted to any other suitable vehicle which may be driven by the floor levelling vehicle or by any other suitable vehicle, as long as its displacement members are moving over the first and second tracks levelled by the first and second grinding tool 3, 12.

The floor levelling vehicle of this invention preferably comprises two additional grinding tools mounted to opposite sides in cross direction of the floor levelling vehicle. The additional grinding tools 8, 18 may be mounted to the floor levelling vehicle or to an additional vehicle, which is connectible to the floor levelling vehicle. The additional grinding tools 8, 18 may be mounted at a position which corresponds to the position of the grinding tools 3, 12 on the vehicle body, in cross direction thereof. This way each undulation will be worked twice by the levelling vehicle and an improved levelling may be obtained in one go. The additional grinding tools 8, 18 may however also be disposed on a position which extends from the grinding tools 3, 12 in cross direction of the vehicle. In that case preferably the path polished by grinding tool 3 and the corresponding additional grinding tool 8 partly overlap in cross direction of the vehicle body, to permit the levelling of a path with a wider width. Preferably also the path polished by grinding tool 12 and the corresponding additional grinding tool 18 partly overlap in cross direction of the vehicle body. This way a second path may be levelled which partly overlaps the first path that has been levelled by grinding tools 3, 12 so that the risk to the occurrence of a central longitudinal rim or undulation may be minimised. Such a rim or undulation would be formed with subsequent grinding tools being positioned in such a way that their polishing surfaces extend right along each other or at a small distance from each other. Of course when levelling the second path, the grinding tools 3, 12 will be lifted so that they do not contact the floor. To optimise the levelling, the additional vehicle will usually comprise displacement members which are positioned such that they are moving over the path that has been worked by the grinding tools 3, 12. Usually the levelling by the additional grinding tools 8, 18 will only be carried out after the levelling by the grinding tools 3, 12 has been finished to an acceptable extent.

The additional grinding tool may be any grinding tool considered suitable by the skilled person, and it may be the same as the grinding tool 3, 12 or it may be a different one.

The at least one grinding tool 3, 12 preferably comprises a polishing disk which is rotatable about an axis which extends in height direction of the floor levelling vehicle. Usually the disk will be rotatable in a direction parallel to the floor surface. The polishing device is provided to contact the floor surface that needs to be levelled so as to remove an amount of material from the floor to achieve the desired degree of levelling. Thereby the polishing surface of the disk may run parallel to the undulations, or extend under an angle and both situations may occur. The rotational movement of the polishing devices may be driven either by the driving of the vehicle or each polishing device may be driven by its own driving 4, 14 the latter being preferred. For practical reasons the driving of the polishing devices is connected to the first driving of the vehicle.

To ensure an optimum contact between the grinding tools 3, 12, 9, 19 and the floor, the grinding tools are hingedly mounted with respect to the vehicle body and means are provided which permit fixing the grinding tools in a certain position. Preferably the hinged connection extends in all directions, i.e. over 360°. This may for example be achieved using a pivoting joint. When moving over the slope of an undulation, the polishing surface 5 of the polishing device will automatically follow the surface of the slope, move over the surface that slope and remove material along the surface of that slope. In case the polishing device would not be hingedly mounted, the edge of the polishing disk would contact the slope of the undulation and protrude into the undulation, as a consequence of which the floor levelling vehicle would get jammed.

As a grinding tool or polishing device, any device considered suitable by the person skilled in the art may be used.

The position of the grinding tools 3, 12 will usually be adjusted in such a way that the polishing surface 5 extends at a level somewhat below the contact surface between the displacement members 10, 11, 20, 21. This way undulations are removed to a level somewhat below the contact surface between the back displacement means and the floor surface and an improved levelling is obtained. A first grinding tool 3 is mounted to the vehicle body, preferably to the first longitudinal 1 axis, at a position between the first front and back displacement members 10, 20. A second grinding tool 4 is mounted to the second axis 2 at a position between the second front and back displacement member 11, 21. The grinding tools 3, 4 and displacement members 10, 11, 20, 21 may be mounted to a common axis, for example to the longitudinal axes 1, 2, so that varying the distance between the axes implies a corresponding change of the distance between the grinding tools, but this is not mandatory. It can for example also be envisaged to mount the grinding tools 3, 12 to a support plate in such a way that the distance between them may be varied independently of the distance between the displacement members 10, 11, 20, 21 in cross direction of the vehicle. Or it can be envisaged to mount the displacement members in such a way to the vehicle that the distance in cross direction of the vehicle, between the front displacement members 10, 11 may be varied independently of the distance between the back displacement members 20, 21, the distance between the back displacement members being independently variable as well. However, thereby care has to be taken to position the grinding tools and back displacement members such that the back displacement members always travel over a track that has been worked by the corresponding grinding tool. This improves the smoothness of the levelling that may be achieved.

The cross axis 5 may take any position with respect to the first and second longitudinal axes 1, 2, but is preferably positioned substantially central in longitudinal direction of the axes or the vehicle body 15. The grinding tools 3, 12 may take any position with respect to the first and second longitudinal axes 1, 2, but are preferably positioned substantially central in longitudinal direction of the axes or the vehicle body 15. Similarly, the front displacement members 10, 11 are positioned at the same distance from the middle of the longitudinal axes 1, 2 or the vehicle body 15 as the back displacement members 20, 21. This way a levelling vehicle is obtained which is symmetric in longitudinal direction. As a result the direction in which the vehicle is moving may be reversed, without the need to turn the vehicle around, while the nature of the levelling operation remains unchanged. This is advantageous especially in case a floor needs to be levelled in a space with little space to move the vehicle around.

Within the scope of this invention it is preferred that the displacement of the first and second front and back displacement member 10, 11, 20, 21 is driven by a vehicle driving 24 which is separate from and mounted externally to the floor levelling vehicle of this invention, but which is connected to the floor levelling vehicle. This permits severely reducing the dimensions of the vehicle and renders the vehicle much more manoeuvrable and easily transportable. The floor levelling vehicle of this invention is thus suitable for use in corridors of widely varying dimensions, from rather small widths of one or a few meters to several meters. The length of the connection between the driving and the vehicle is preferably variable, which permits positioning the driving at a rather fixed position while the vehicle is moving over the floor that needs to be levelled. As a driving device 24 for the vehicle, any driving considered suitable by the person skilled in the art may be used. The driving may for example be an electro motor which is positioned remote from the floor surface that needs to be worked. However any other suitable driving may be used as well. Preferably the driving is revertible in such a way that the vehicle body may driven in opposite directions by the same driving without having to turn the vehicle around.

When in use for the levelling of a corridor in a warehouse, the mobile floor levelling vehicle of this invention operates as follows.

Figure 3B:
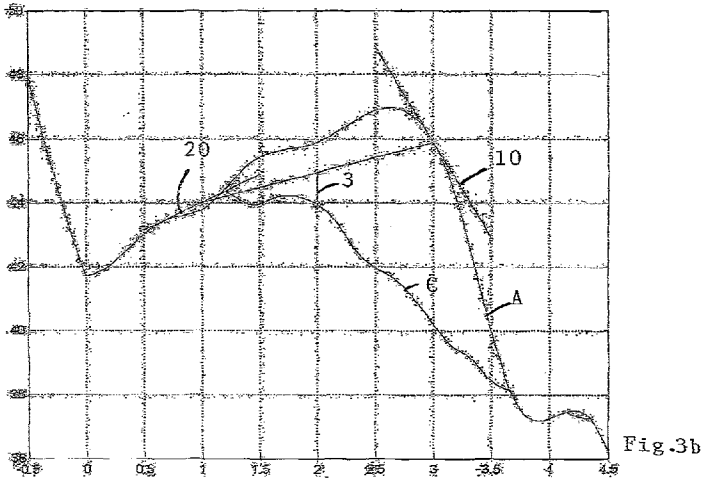
FIG. 3 shows the displacement of the displacement members over undulations occurring on the floor, in particular on the Y-axis the absolute height (in mm) of the undulations occurring on the floor as a function of length of the path to be levelled (in m) on the X-axis.
Figure 3A:
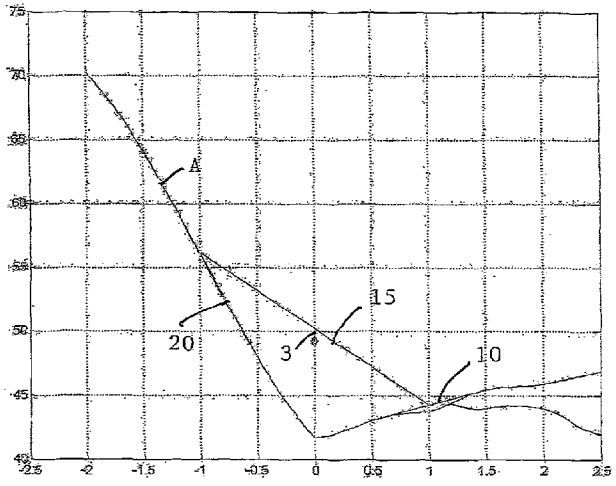
Figure 3D:
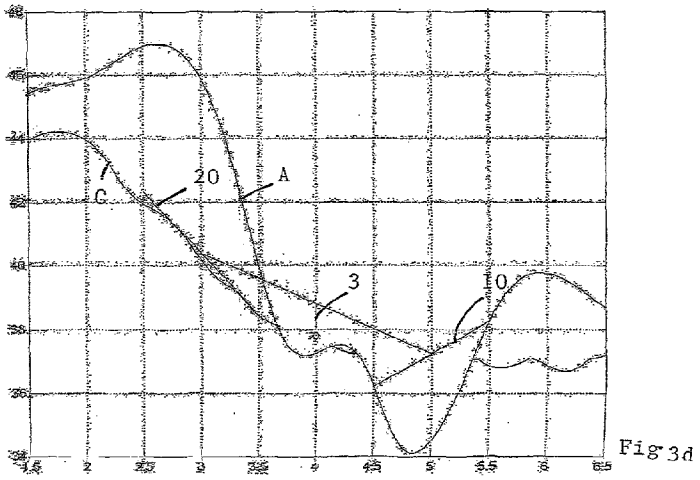
Figure 3C:
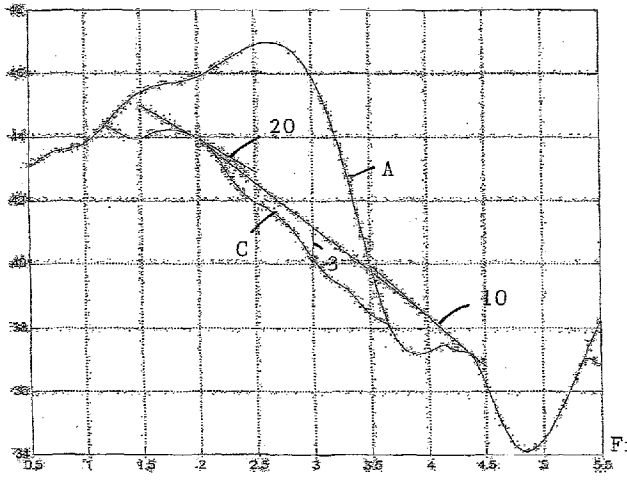
Figure 3E:
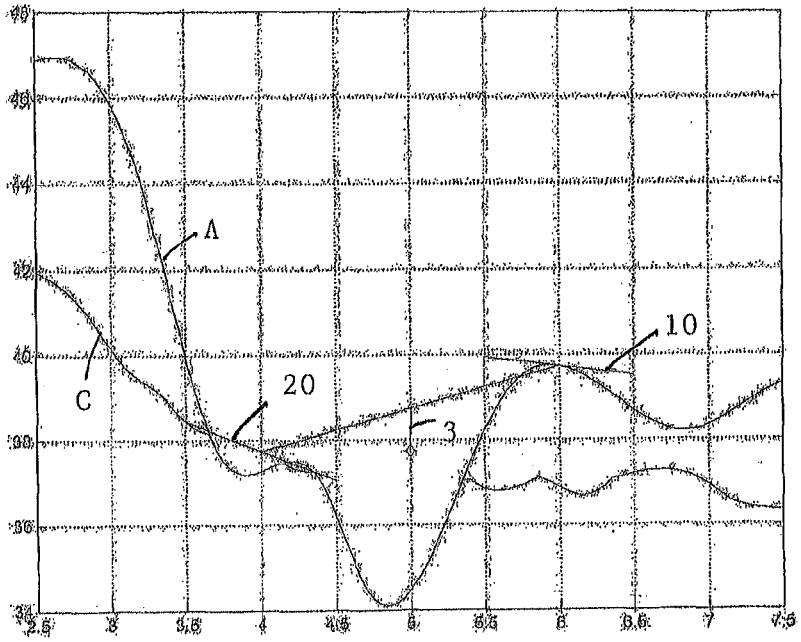
Figure 3F:
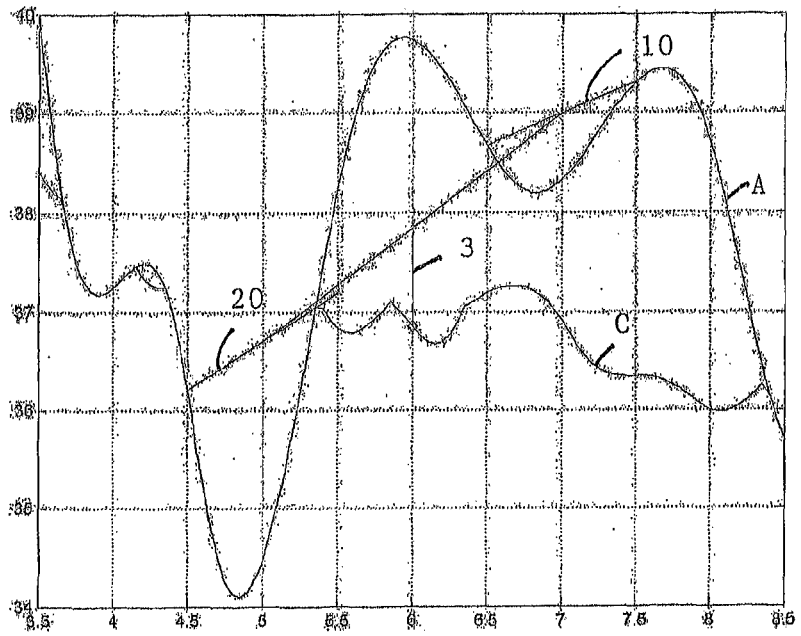

As can be seen from FIG. 3*a*, the front displacement member 10 averages the contact surface area between the bottom ground contacting face of the displacement member and the top of two subsequent undulations, while the back displacement member 20 is located at an undulation with a steep slope at the start of the track. The shape of the original floor is designated A. The grinding tool being located on the rigid axis between the front and back displacement member does not touch the floor. FIG. 3*b* shows the case where the front displacement member is moving over an undulation having a wavelength that corresponds to or is larger than the length of the front displacement member. Shown is the case where the front displacement member 10 is displaced over the top of the undulation while the back displacement member 20 is located on the slope of that undulation. The grinding tool will remove an amount of material corresponding to the position shown in FIG. 3*b* by line B. As the front displacement member moves downward along the slope of the undulation, and the back displacement member 20 is displaced over the track polished by the grinding tool, the floor is levelled as shown in C. When the front displacement member moves further forward over the next undulation shown in FIG. 3*c*, the back displacement member is forwarded over the track levelled by the grinding tool designated with C. From FIG. 3*c* it appears that a valley in the floor having a wavelength shorter than the length of the front displacement member 10, is not detected by the front displacement member 10 and the front displacement member proceeds over the subsequent tops. If this would not be the case and the displacement member would follow the level of the valley, the position of the grinding tool would be lowered and more material would be removed, this going at the expense of the levelling speed. In that case the amplitude of the undulation would be reduced, but a new undulation would be created at a wavelength corresponding to the distance between the front and back displacement means. FIG. 3*d* shows the case where the floor surface contains a hole having a wavelength shorter than the length of the front displacement member. The back displacement member 20 is at a level above the front displacement member 10. The position of the axis connecting both is such that the grinding tool 3 does not contact the floor, and no material is removed. As the floor levelling vehicle moves further forward (FIG. 3*e*) the grinding tool is advanced over the hole, no material is removed. When the back displacement member is moved over the valley and the front displacement member has moved over the slope of a subsequent undulation, the position of the rigid axis and grinding tool is as shown in FIG. 3*f* and material is removed until profile F is obtained.

The overall result of the levelling operation over the total length of the path that has been levelled, is shown in FIG. 4*a*1-FIG. 4*d*1, for the left track of the corridor and the left grinding tool 3, in FIG. 4*a*2-FIG. 4*d*2 for the right track of the corridor polished by the right grinding tool 12. Line I shows the profile obtained after one single levelling operation, lines II and III show the profile obtained after re-working the floor surface once and twice. Lines IV-IX show the floor profile obtained after re-working the floor surface three, four, five, six, seven and eight times respectively. In that case the front displacement members are forwarded over the track that has been worked once, respectively twice by the grinding tools, whilst the back displacement members are forwarded over a track that has been worked twice and three times by the grinding tools.

From FIGS. 5*a*1 and 5*a*2 it can be observed that after respectively a left and right track on the floor have been subjected to a first levelling operation, undulations are not completely removed from the floor. A indicates the original floor profile, B the profile after one levelling operation. Moreover, new undulations may be created with occur at a frequency that is not acceptable for vehicles riding over the floor. However by repeating the levelling operation a sufficient number of times, the undulations occurring at unwanted frequencies are removed as can be seen from FIG. 5*b*1 profile C for the track levelled by the left grinding tool and FIG. 5*b*2 profile C for the track levelled by the right grinding tool.

If so desired, the polishing operation may be repeated once more, this time with a first additional grinding tool disposed at a position that corresponds to a position between the first and second grinding tool 3, 12. Thereto use is made either of a separate vehicle to which the first additional grinding tool is mounted, whereby the displacement means of the separate vehicle are provided to move over the tracks polished by the first and second grinding tool 3, 12. However thereby use can also be made of the floor levelling device of this invention with the first and second grinding tool lifted so that they do not longer contact the floor. That way, the front and back displacement members are moving over respectively a parallel first and a second path that has been levelled the desired number of times, and a third path between the first and the second is levelled as well. Thereby, the path levelled by the third grinding tool may partially overlap the first and second path or not. Levelling of the central path may be achieved in one go, by positioning the additional polishing tool such that it removes the required amount of material or it may be achieved in two or more operations.

If so desired an additional polishing operation may be carried out using the second and third additional grinding tools 8, 18, which are disposed either on the floor levelling vehicle and which are provided to polish a fourth and a fifth track which may either extend between the first and the second track polished by respectively the first and the second grinding tool 3, 12, or beyond the first and the second track in cross direction of the vehicle body. However, the second and third additional grinding tools 8, 18 may also be mounted on a separate vehicle body. In that case polishing is usually carried out in such a way that the path polished by second additional grinding tool 8 fully or partly overlaps the path polished by the first grinding tool 3, 12 in cross direction of the vehicle body. Preferably also the path polished by third additional grinding tool 18 and the second grinding tool 12 partly overlap in cross direction of the vehicle body. This way a path of a larger width may be polished, with a minimum risk to forming a groove or rim between the paths polished by the grinding tools 3, 12 and the additional grinding tools 8, 18. However, polishing by the additional grinding tools 8, 18 may also be carried out such that their tracks do not overlap the tracks levelled by the grinding tools 3, 12, but this depends on the intended application.

The invention claimed is:

1. A mobile floor levelling vehicle for levelling an undulating floor surface, which floor levelling vehicle comprises a vehicle body with a front and a back and a first and second longitudinal side, displacement means for moving the vehicle, comprising front displacement means mounted to the front of the vehicle body and back displacement means mounted to the back of the vehicle body;

a first vehicle driving for driving the movement of the displacement means at least one grinding tool mounted to the vehicle body, the grinding tool being provided to contact the floor surface that needs to be levelled and to remove an amount of material from the floor to achieve the desired degree of levelling, the movement of the grinding tool being driving by a second driving, characterised in that the front displacement means comprise a first and second oblong front displacement member mounted respectively to the opposite first and second longitudinal sides of the vehicle body, which first and second front displacement member extend in longitudinal direction of the vehicle and are rigid in longitudinal direction the back displacement means comprise a first and second oblong back displacement member mounted respectively to the first and second longitudinal side of the vehicle body in cross direction thereof, the first and second back displacement members extending in longitudinal direction of the vehicle wherein the first front and back displacement member are mounted to a first rigid longitudinally extending axis of the vehicle body, and the second front and back displacement member are mounted to a second rigid longitudinally extending axis of the vehicle body, wherein the first front and back displacement members on the one hand and the second front and back displacement members on the other hand are provided to move over a same track wherein the back displacement members are provided to move over a track that has been levelled by the at least one grinding tool, wherein the front and back displacement members are tiltable with respect to the vehicle body in longitudinal direction of the vehicle.

2. A mobile floor levelling vehicle as claimed in claim 1, characterised in that the floor leveling vehicle comprises means for varying the distance between the first and second grinding tool.

3. A mobile floor levelling vehicle as claimed in claim 2, characterised in that the first front displacement member, the first grinding tool and the first back displacement member are mounted to a first longitudinally extending axis, in that the second front displacement member, the second grinding tool and the second back displacement member are mounted to a second longitudinally extending axis and in that the distance between the first and second longitudinal axis is adjustable in cross direction of the vehicle.

4. A mobile floor leveling vehicle as claimed in claim 2, characterized in that the distance varying means comprise a first and a second co-axial pipe which extend in cross direction of the vehicle, the first and second pipe being slideable with respect to each other and rotatable with respect to each other along a longitudinal axis of the pipe, the first pipe being connected to the first longitudinal axis of the vehicle body, the second pipe being connected to the second longitudinal axis of the vehicle body.

5. A mobile floor leveling vehicle as claimed in claim 1, characterized in that the at least one grinding tool comprises a polishing device which comprises a polishing disk rotatable about an axis which extends in height direction of the floor levelling vehicle.

6. A mobile floor leveling vehicle as claimed in claim 5, characterized in that the at least one polishing device is tiltable in longitudinal direction of the vehicle body and means are provided to fix the polishing device in a tilted position.

7. A mobile floor levelling vehicle as claimed in claim 1, characterised in that the frontside displacement means are selected from the group of a sliding or wheeled skate, a caterpillar surrounding two or more wheels.

8. A mobile floor levelling vehicle as claimed in claim 7, characterised in that the backside displacement means are selected from the group of a sliding or wheeled skate, a caterpillar surrounding two or more wheels.

9. A mobile floor leveling vehicle as claimed claim 1, characterized in that the first and second front displacement members respectively comprise a first and second front end and the first and second back displacement members respectively comprise a first and second back end and in that the first and second front end are connected by means of a front rigid member, and in that the first and second back end are connected by means of a back rigid member.

10. A mobile floor leveling vehicle as claimed in claim 1, characterized in that the first and second longitudinal axes comprise a first and second front axis part and a first and second back axis part, and in that the first and second front axis parts are connected to each other by means of an axis connecting member which extends in cross direction of the vehicle, wherein the opposite end parts of the front connecting member are fastened to the front end of the first and second axis by means of a first and second front pivoting joint and wherein the opposite end parts of the back connecting member are fastened to the back end of the first and second axis by means of a first and second back pivoting joint to permit movement in height direction of the vehicle.

11. A mobile floor levelling vehicle as claimed in claim 1, characterised in that the position of at least one grinding tool is adjustable in height direction of the vehicle.

12. A mobile floor leveling vehicle as claimed in claim 1, characterised in that the front and back displacement members have the same length and in that the at least one grinding tool is positioned at a position central between the front and back displacement means.

13. A mobile floor leveling vehicle as claimed in claim 1, characterized in that the vehicle comprises an additional vehicle which is removably mountable to the vehicle body of the floor leveling vehicle and which comprises at least one grinding tool which is positioned in such a way that it works a surface area that has not been worked by the first and second grinding tools.

14. A mobile floor leveling vehicle as claimed in claim 1, characterized in that the vehicle comprises an additional vehicle, which is removably mountable to the vehicle body of the floor leveling vehicle and which comprises at least a first and a second additional grinding tool positioned at a distance from each other which is variable.

15. A mobile floor leveling vehicle as claimed in claim 1, characterized in that the vehicle driving and the driving of the grinding tool are separate from and mounted externally to the floor levelling vehicle and connected thereto.

16. A method for polishing an undulating floor wherein the mobile floor leveling vehicle of claim 1 is moved over a corridor floor that needs to be levelled, wherein a first and second track on opposite sides of the corridor are leveled by respectively the first and second grinding tool, followed by moving the first and second back displacement member over the first and second track, wherein the leveling operation is repeated by moving the first and second displacement member over the first and second track and the first and second track are worked again by the first and second grinding tool.

17. A method as claimed in claim 16, characterized in that a third track positioned between the first and second track is worked by an additional grinding tool connectible to the floor leveling vehicle, whereby the additional grinding tool is moved by displacement members which are provided to move over the worked first and second tracks.

18. A method as claimed in claim 16, characterized in that a fourth and a fifth track positioned between or beyond the first and second track are worked by an additional grinding tool which is connectible to the floor leveling vehicle, whereby the additional grinding tool is moved by displacement members which are provided to move over the worked first and second tracks.

* * * * *